US005230641A

United States Patent [19]

Wharton

[11] Patent Number: 5,230,641

[45] Date of Patent: Jul. 27, 1993

[54] ELECTRICAL RECEPTACLE

[75] Inventor: Richard F. Wharton, Glenview, Ill.

[73] Assignee: Safco Corporation, Chicago, Ill.

[21] Appl. No.: 925,189

[22] Filed: Aug. 6, 1992

[51] Int. Cl.[5] ..... H01R 17/18

[52] U.S. Cl. ..... 439/668; 439/700; 439/824

[58] Field of Search ..... 439/578–585, 439/700, 824, 295, 668, 669, 638

[56] References Cited

U.S. PATENT DOCUMENTS

| | | | |
|---|---|---|---|
| 1,264,255 | 4/1918 | Anklam | 439/700 |
| 2,010,452 | 8/1935 | Douglas | 439/700 |
| 2,480,963 | 9/1949 | Quinn | 439/700 |
| 3,032,741 | 5/1962 | Fitzgerald | 439/824 |
| 3,955,876 | 5/1976 | Knuppel | 439/700 |
| 4,591,222 | 5/1986 | Shaffer | 439/700 |

*Primary Examiner*—David L. Pirlot
*Attorney, Agent, or Firm*—Augustus G. Douvas

[57] ABSTRACT

An electrical receptacle which has a plastic housing defining a socket lined by a tubular sleeve contact for receiving a conventional electrical adapter plug. The adapter plug has a body supporting a contact tip which is either retractable or non-retractable. This contact tip projects from an end of the adapter-plug body to mate with a central contact located at one end of the receptacle socket. The adapter plug also has another contact which projects from the periphery of the adapter-plug body to mate with the sleeve contact of the receptacle. The central contact of the receptacle is carried on a support fixed to the housing which communicates with the receptacle socket to establish electrical circuit connection with the adapter-plug contact tip in response to the insertion of the adapter plug into the socket. The central contact is spring-loaded and movable relative to its support so as to provide a retracting movement in response to the force applied by an adapter-plug contact tip. The spring-loaded retracting action of the central contact establishes and maintains a reliable circuit connection particularly with respect to an adapter plug which has a fixed contact tip. The retracting movement of the central contact assumes a reliable electrical connection between an adapter plug inserted in the receptacle in response to vibration of either or both the adapter plug and the receptacle.

3 Claims, 2 Drawing Sheets

ELECTRICAL RECEPTACLE

BACKGROUND OF THE INVENTION

This invention relates to an electrical receptacle, and more particularly to a receptacle generally similar to those used with cigar lighters to receive an adapter plug for connecting a 6-volt or 12-volt power source to a light or electrical appliance.

Many cigar lighter type receptacles currently being manufactured employ a design concept in which a housing and negative contact of one piece is formed into a deep drawn steel socket. The steel socket has lanced fingers running axially to provide friction on the ash guard of the lighter and is provided with means at the bottom of the socket to receive a ceramic insulator. By various means depending upon the specific manufacturer's design, a male screw thread member is fitted to the closed end of the socket to mate with a deep drawn nut member designed to hold the receptacle in the dash board of an automobile and, depending upon its tightness, to create a ground contact. This ceramic insulator is centered in the socket and is designed to receive a bi-metal assembly which makes the positive contact with the cigar lighter. When the heating element of the cigar lighter is pressed down into the socket, positive contact is made with the outside of the heating element of the bi-metals. The heating element conducts heat to the bi-metals which are designed to distort with heat so that they release the lighter assembly and allow it to "pop out". The lighter assembly will pop out to the extent that is allowed to do so by the lanced fingers in the negative contact socket which hold the ash guard in position precluding the lighter from popping completely out of the socket.

Adapter plugs were subsequently designed so that trouble lights and other electrical appliances having their own cords could be used in or around automobiles, without requiring the user to provide any special receptacle or connecting means. Such adapter plugs typically comprise a body for insertion into a cigar lighter receptacle, with retractable spring-loaded contact tips at a forward end and also on one side to make contact respectively with the bi-metal element and the steel socket.

In a current design of a receptacle, the bi-metallic element is removed and replaced by a brass machine screw to make the positive contact and the socket is modified only by the deletion of the side lances, which are of course not required for cooperating with adapter plugs. This receptacle is now used as a standard structure for extension cord receptacles. With the advent of recreational vehicles and similar requirements for sources of 12-volt electrical power, these receptacles are also mounted into wall plates for use as 12-volt convenience outlets. For extension cord use, a plastic device similar in shape to a standard bicycle handle grip may be placed around the outside of the receptacle to enhance its appearance and to prevent damage to the electrical connections.

In certain types of currently-manufactured adapter plugs, the retractable spring-loaded contact tip is replaced with a non-retractable contact tip that is fixed relative to its adapter-plug body. When a fixed, adapter-plug contact tip establishes an electrical connection with a receptacle fixed-central contact, any slight vibration of the connecting element affects the integrity of the connection. In most instances, the connection will be interrupted or permanently broken.

SUMMARY OF THE INVENTION

Accordingly, a principal object of this invention is to provide an improved electrical receptacle which establishes a reliable electrical connection with an adapter plug having a non-retractable contact tip.

Another object is to provide an improved electrical receptacle which establishes a reliable electric connection with adapter plugs of both retractable and non-retractable contact tip designs.

A preferred embodiment of the electrical receptacle of this invention features a plastic housing defining a socket lined by a tubular sleeve contact for receiving by insertion an electrical adapter plug. This adapter plug has a body supporting a contact tip which projects from the end of the body to mate with a receptacle central contact and another contact which projects from the periphery of the adapter-plug body to mate with the receptacle sleeve contact. The receptacle includes a wall-supported central contact which communicates with the socket to establish electrical circuit connection with the adapter-plug contact tip in response to the insertion of the adapter plug into the socket. The central contact is spring-loaded and movable relative to its support so as to provide a retracting movement in response to the establishment of an electrical circuit connection with the adapter-plug contact tip. The spring loaded retracting action of the central contact establishes and maintains a reliable circuit connection particularly with respect to an adapter plug which has a fixed contact tip. Without the movable central contact the connection is broken in response to vibration of the adapter plug.

DESCRIPTION OF THE DRAWINGS

In order that all of the structural features for attaining the objects of this invention may be readily understood, reference is made to the drawings in which.

DETAILED DESCRIPTION OF THE PREFERRED EMBODIMENT

Figure 6:
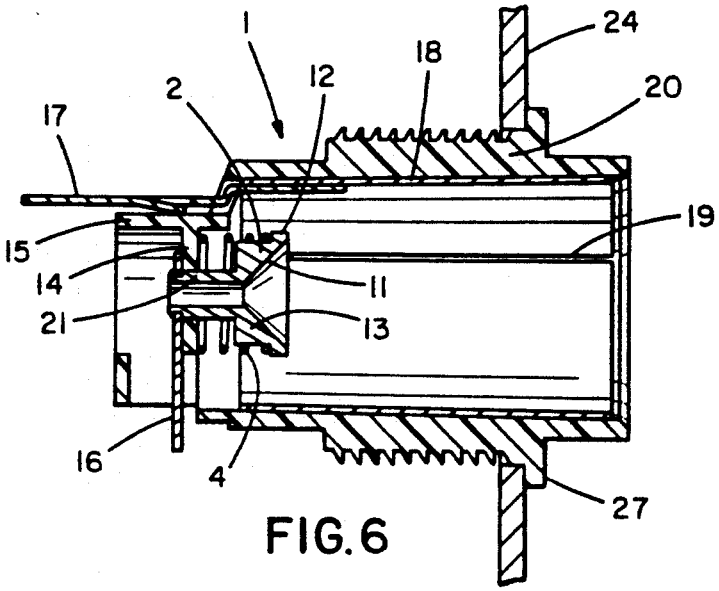
FIG. 6 is a section view taken along line 6—6 of FIG. 3 which shows the central contact in its spring-projected position.
Figure 7:
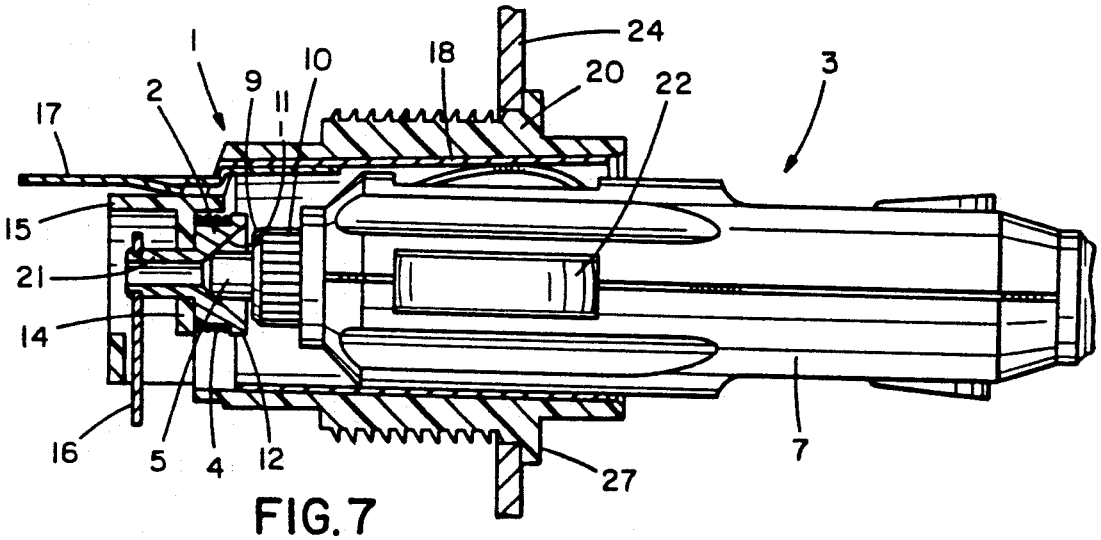
FIG. 7 is a view related to FIGS. 1 and 6 which shows the receptacle central contact driven to a retracted position by the adapter plug of FIG. 1 which has a non-retractable contact tip.

Referring to the drawings, a principal structural feature of electrical receptacle of this invention relates to spring-loaded central contact 2 (FIGS. 6 and 7) which retracts upon insertion of adapter plug 3 into the socket formed by the receptacle (FIG. 7). Contact 2 is usually of positive electric polarity.

The contoured body of contact 2 is enveloped by helical-coil spring 4 which drives contact 2 to the projected position shown in FIG. 6. Accordingly, contact 2 is capable of assuming either a projected position (FIG. 6), a retracted position (FIG. 7), or an intermediate position (FIG. 8) between full projection and full retraction.

Figure 8:
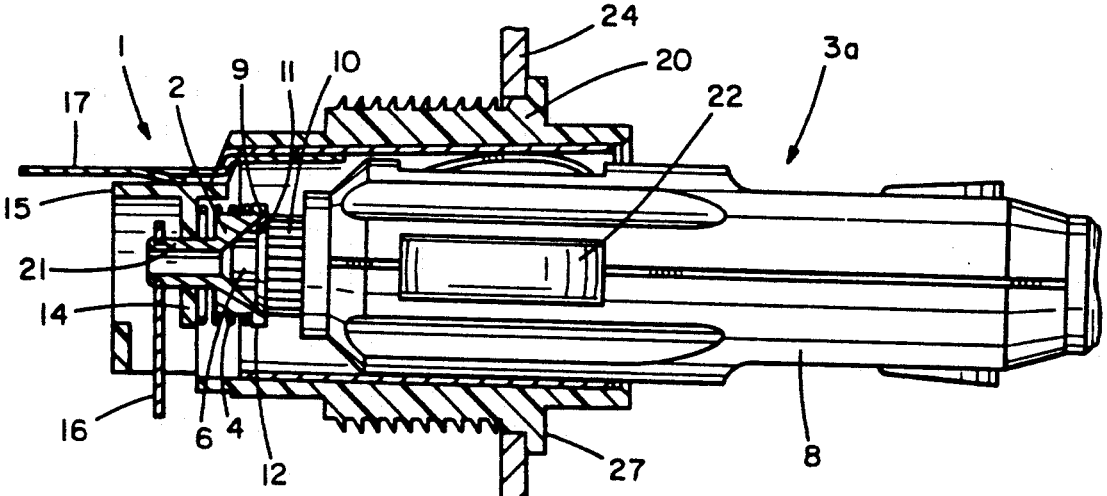
FIG. 8 is a view which shows the receptacle central contact driven to a retracted position by an adapter plug which has a retractable contact tip.

Adapter plugs, such as adapter plug 3, typically are constructed with either a fixed projecting contact tip 5 (FIGS. 1 and 7), or a retractable contact tip 6 (FIG. 8). That is, the contact tip 5 can be either fixed relative to the body 7 of adapter plug 3 (FIG. 7), or contact tip 6 can be spring loaded so that it can be forced into a retracted position relative to the body 8 of adapter plug 3*a* (FIG. 8). Regardless of the type of contact tip employed in an adapter plug, the tip usually makes connection to a positive-polarity receptacle central contact. Thus, contact tips 5 and 6 usually make connection to a positive-polarity receptacle central contact.

The movable design of receptacle central contact 2 enables receptacle 1 to establish a firm and reliable electrical connection with an adapter plug having either type of contact tip 5 or 6. An adapter plug that is designed to lock into the bimetallic fingers (not shown) of a cigarette-lighter receptacle does not normally have a spring-loaded, retractable contact tip, but rather has a fixed contact tip. When a fixed adapter-plug contact tip establishes an electrical connection with a fixed-central contact of a receptacle, any slight vibration of the connecting elements affects the integrity of the electrical connection. In most instances the connection will be lost. With the spring-loaded design of receptacle central contact 2, the connection is maintained even though the adapter plug has a fixed contact tip 5 (FIG. 7).

When receptacle 1 is used with a retractable contact tip 6, both contact elements 2 and 6 are capable of accommodating adjustment (FIG. 8) so that a reliable electrical contact is also established with this type of adapter plug 3*a*. In this situation, both contact tip 6 and beveled edge 9 of knurled adapter-plug nose element are firmly seated against truncated-conical socket wall 11 of central contact 2 (FIG. 8).

Central contact 2 is preferably fabricated of brass and is formed with an annular shoulder 12. Coil spring 4 envelopes a reduced peripheral portion of body 13 of contact 2, and is sandwiched between shoulder 12 and plastic support wall 14. Spring 4 exerts a force against annular shoulder 12 and support support wall 14 tending to project central contact 2 as is shown in FIG. 6 Support wall 14 extends across the interior of a generally U-shaped contact guard 15. Guard 15 is fabricated of plastic, and it isolates protectively electric terminal 16 fixed to contact 2 from electric terminal 17 fixed to receptacle sleeve 18.

Sleeve 18 is preferably fabricated of brass, and is split at seam 19 (FIG. 6) so as to fit tightly within the bore o±generally tubular receptacle housing 20. Contact guard 15 and housing 20 are formed as an integral plastic part preferably of an opaque plastic, such as black polypropylene.

Contact 2 is formed with a shank 21 to which terminal 16 is fixed. Shank 21 reciprocates within a hole formed in support wall 14 to provide for the movement of contact Z against the force of spring 4. Terminal 16 is fixed to shank 21 so that the terminal also serves as a movement-limit stop for contact 2.

Figure 1:
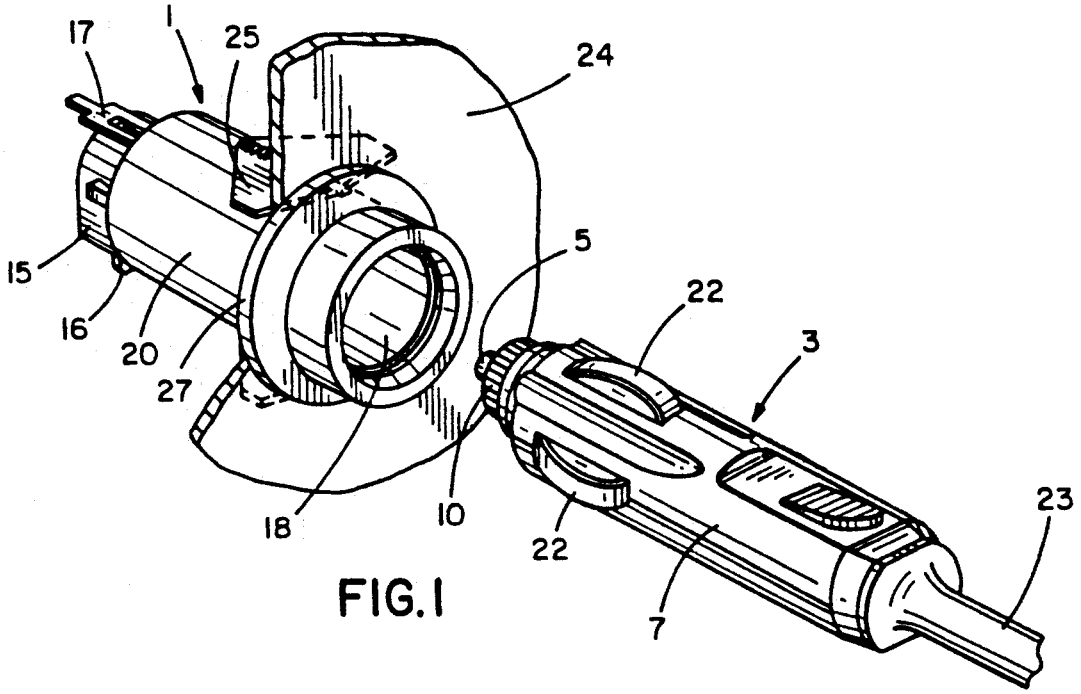
FIG. 1 is an isometric view showing the application of an electrical adapter plug to the electrical receptacle of this invention mounted on a support wall.
Figure 2:
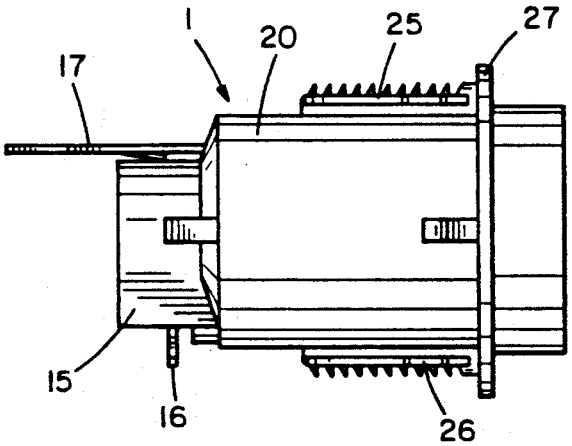
FIG. 2 is a side elevation view of the electrical receptacle.
Figure 3:
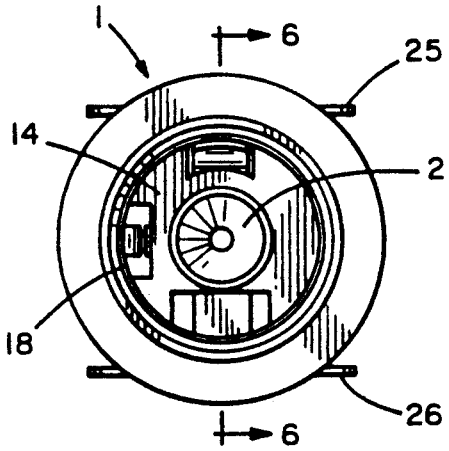
FIG. 3 is a front elevation view of the electrical receptacle which shows the retractable central contact.
Figure 4:
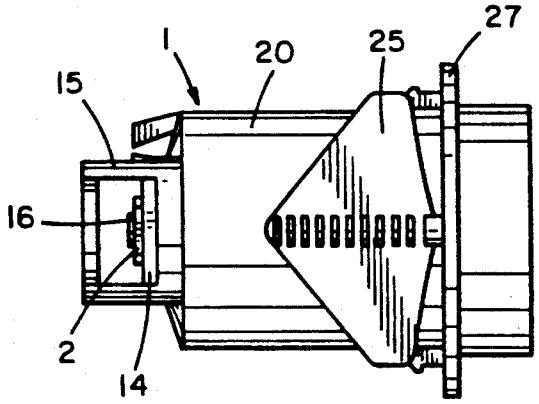
FIG. 4 is a plan view of the electrical receptacle.
Figure 5:
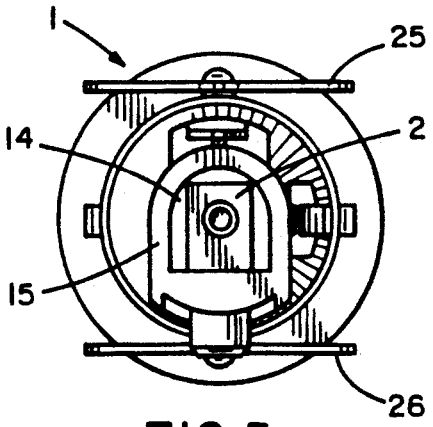
FIG. 5 is a rear elevation view of the electrical receptacle which shows the support structure for the central contact.

Terminal 16 usually serves as a positive polarity connection to receptacle 1, and terminal 17 usually serves as a negative polarity connection to receptacle 1. Accordingly, upon insertion of adapter-plug 3 into receptacle 1, a positive electric potential is applied to contact tip 5, and a negative electric potential is applied to two commonly-connected contacts 22 (FIG. 1) of adapter plug 3. This voltage is outputted at line cord 23 (FIG. 1).

Housing 20 is formed with an annular mounting flange 27 which seats receptacle on panel 24. Conventional plastic locking flaps 25 and 26, formed as part of housing 20, are flexed against the outside periphery of housing 20 so that receptacle 1 can engage a mounting hole in panel 24. Upon manual release of locking flaps 25 and 26, receptacle 1 is fixed and locked to panel 24.

It should be understood that the described embodiment of receptacle merely illustrates the principles of this invention, and that modifications can be made without departing from the scope of the invention.

What is claimed is:

1. A female electrical receptacle for receiving by insertion a male electrical adapter plug having a plug body which supports a contact tip which projects from an end of the plug body and a second contact which projects from the periphery of the plug body: comprising a housing defining a socket for receiving the electrical adapter plug; a tubular sleeve contact lining the socket to engage the second contact upon insertion of the adapter plug into the receptacle; an apertured central-contact support fixedly disposed in the interior of the housing to define generally an end of the socket; a central contact having a contoured body formed with a head having an annular periphery, an enlarged annular shoulder projecting beyond the annular periphery of the head at an end of the head located away from the contact support, a flat annular face at the opposite end of the head adjacent the support, and an elongated shank integrally fixed to and projecting from the flat annular face and engaged in the aperture of the contact support; a helical spring enveloping the annular periphery of the head and locked between the shoulder of the head and the contact support; and a terminal fixed to and projecting from an end of the shank with the terminal and the flat annular face of the head defining limit stops for the reciprocating movements of the central contact in response to the insertion of and also the removal of an adapter plug with respect to the receptacle.

2. The electrical receptacle of claim 1 in which the central contact is formed with a frusto-conical flat-bottomed recess having an access opening located within the confines of the annular shoulder to receive a mating adapter-plug contact tip.

3. The electrical receptacle of claim 1, comprising a protective guard partially enveloping the shank and the terminal fixed to the shank, with the guard being formed with an access opening through which the terminal projects.

* * * * *